US006461154B2

(12) United States Patent
Piringer et al.

(10) Patent No.: US 6,461,154 B2
(45) Date of Patent: Oct. 8, 2002

(54) METHOD FOR BURNING CARBONATE-CONTAINING MATERIAL

(75) Inventors: Hannes Piringer, Beinwil am See (CH); Walter Egger, Radenthein (AT)

(73) Assignee: Maerz Ofenbau AG, Zurich (CH)

( * ) Notice: Subject to any disclaimer, the term of this patent is extended or adjusted under 35 U.S.C. 154(b) by 0 days.

(21) Appl. No.: 09/827,464

(22) Filed: Apr. 6, 2001

(65) Prior Publication Data

US 2001/0029005 A1 Oct. 11, 2001

(30) Foreign Application Priority Data

Apr. 11, 2000 (CH) ..... 0721/00

(51) Int. Cl.[7] ..... F27D 15/02
(52) U.S. Cl. ..... 432/19; 432/79; 432/95
(58) Field of Search ..... 432/19, 79, 95, 432/96, 97

(56) References Cited

U.S. PATENT DOCUMENTS

| | | | | | |
|---|---|---|---|---|---|
| 3,887,326 | A | * | 6/1975 | Townley | 432/99 |
| 4,315,735 | A | * | 2/1982 | Fussl et al. | 432/96 |
| 4,382,779 | A | * | 5/1983 | Fussl | 432/96 |
| 4,534,731 | A | * | 8/1985 | Fussl et al. | 432/95 |
| 4,747,773 | A | * | 5/1988 | Predescu et al. | 432/95 |

* cited by examiner

*Primary Examiner*—Gregory A. Wilson
(74) *Attorney, Agent, or Firm*—Ladas & Parry

(57) ABSTRACT

In a method for burning carbonate-containing material the latter moves as a result of gravity in counter-current to the cooling and combustion air through a shaft kiln. The fuel supply takes place by means of burning lances introduced into the granular burning material at right angles to the shaft wall. On limiting the grain size and the residence time as a result of this type of fuel supply it is possible to achieve high burning temperatures even suitable for hard burning without there being any sintering together of the granular burning material.

20 Claims, 11 Drawing Sheets

METHOD FOR BURNING CARBONATE-CONTAINING MATERIAL

BACKGROUND OF THE INVENTION

The invention relates to a method for burning carbonate-containing material in a shaft kiln, with gravity conveying through a preheating zone, at least on e burning zone and a cooling zone to a discharge device, fuel supply in the burning zone or adjacent thereto taking place by means of several burning lances passed through the shaft wall and combustion air is supplied under overpressure as cooling air.

Particularly when burning small-grain material, i.e. in the case where a significant proportion of the material to be burned has a grain size of less than 30 mm, the problem arises of supplying in uniform manner to the material the necessary heat quantity, so that each grain can be burned through to its core without the grains sintering together as a result of local overheating and forming solid bridges in the kiln. This problem is particularly pronounced if higher degrees of burning are needed over and beyond soft burned products.

For small-grain burning material and a uniform burning and therefore product quality, it is most appropriate to use rotary kilns, because an intense material circulation ensures a good and uniform heat transfer to each grain or particle. However, it is disadvantageous that they have a very complicated and costly construction and to the correspondingly high capital expenditure must be added the high operating costs resulting from significant levels of wear and high heat losses due to radiation and waste gases, which have a particularly marked effect when using higher temperatures such as are necessary for higher burning levels or other product qualities, such as medium burned, hard burned and sintered products.

Another method uniformly supplying to the product being burned the heat quantity necessary for burning purposes consists of the admixing of fuel, i.e. metallurgical coke to the product being burned in mixed firing kilns. However, mixed firing kilns are unsuitable for small-grained burning material. They also suffer from the significant disadvantage that the ash resulting from the burning of coke remains in the completely burned product and consequently leads to a lower, grey coloured product quality.

An energy-saving operation results from multi-shaft kilns based on parallel flow-regenerative methods using so-called MAERZ kilns. The fuel is supplied in such kilns by burning lances immersed in suspended manner in the material being burned and which are uniformly distributed over the shaft cross-section in the charging zone. However, such known kilns are only suitable for soft burned products.

U.S. Pat. No. 5,460,517 describes how it is possible to burn small-grain burning material by a particular grain size distribution during kiln charging, combined with a special design of the shaft chambers.

If fuel quantities suitable for hard burned products is to be supplied to the burning zone of a shaft kiln, in order to obtain the burning temperatures necessary, hitherto insurmountable difficulties have occurred with regards to obtaining a uniform temperature distribution over the shaft cross-section and in particular preventing a sintering together of burning material as a result of local overheating.

U.S. Pat. No. 4,094,629 proposes reducing the width of the shaft cross-section through an annular construction thereof and to place additional burner orifices in the inner wall obtained. In this way it is possible to maintain a uniform downward movement of the burning material under gravity without the material flow being disturbed by fittings in the shaft.

Fittings in the form of beam-like burner supports are described in GB-A-1111746, which as a result of receiving e.g. in each case twenty liquid-cooled burners have a relatively wide cross-section and consequently bring about a significant reduction in the useful kiln cross-section, associated with the risk of local blocking of gravity conveying of the burning material.

A summary description of various burning methods, including the aforementioned burning in regenerative multi-shaft kilns appears in the handbook "Chemistry and Technology of Lime and Limestone", Robert S. Bynton, second edition, 1987.

The problem of the invention is to find a method of the aforementioned type making it possible to burn in particular small-grained burning material with different degrees of burning and extending to dead burning in an economic manner in shaft kilns so as to bring about a high quality product.

SUMMARY OF THE INVENTION

According to the invention this problem is solved by a method of the aforementioned type and which is characterized in that the supply of fuel takes place by means of numerous burning lances displaceable into the shaft chamber and positioned perpendicularly to the shaft wall through the choice of the position of their orifices in such a way that the individual flames formed at the lances together form a flame area, which at least approximately extends over the entire shaft cross-section.

As each burning lance preferably is intended to only form a single flame, compared with burner supports having numerous burners it has a limited cross-section and consequently only leads to an insignificant influencing of the burning material flow. It has surprisingly been found that the burning lances still have an adequate bending strength to absorb the pressure of the granular burning material flowing round them. Preferably the grain size of the burning material is limited to 70 mm.

As a result of the extension of each burning lance perpendicular to the shaft wall it is ensured that between the said lance and the shaft wall no gap is formed in which the burning material could accumulate. The local restriction to the shaft cross-section through the burning lances projecting into it can be reduced by arranging the burning lances in several superimposed planes circumferentially displaced with respect to those of another plane, so that the necessary fuel quantity is supplied distributed over several shaft planes.

BRIEF DESCRIPTION OF THE DRAWINGS

Further advantageous developments of the method form the subject matter of the dependent claims and can be gathered from the following description and the attached drawings, wherein show:

DETAILED DESCRIPTION OF PREFERRED EMBODIMENTS

Figure 1:
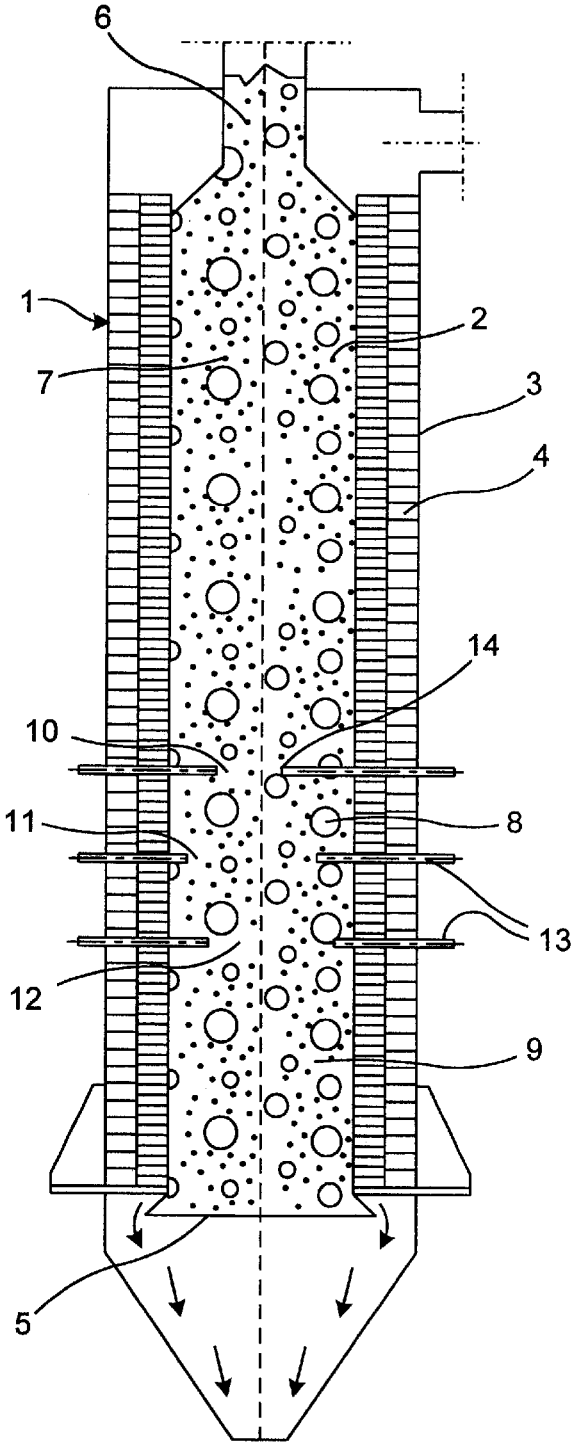
FIG. 1 Diagrammatically an axial section through a single shaft kiln with burning lances projecting in superimposed manner and in three planes into the shaft.
Figure 2:
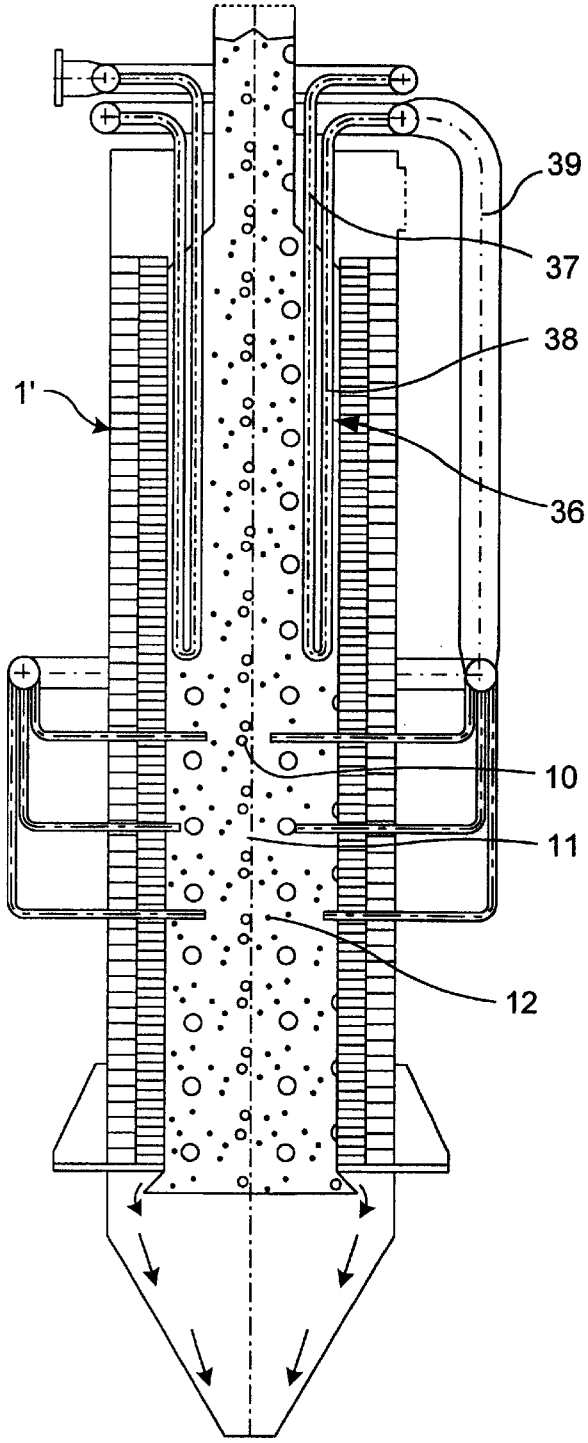
FIG. 2 A single shaft kiln corresponding to FIG. 1, but with heat exchange tubes located in the shaft.

The single shaft kiln shown in longitudinal sectional form in FIG. 1 is vertically oriented and at least over the areas of its length significant from the process engineering standpoint has a shaft chamber 2 with a constant cross-section, which can e.g. be circular, elliptical or polygonal. In the example corresponding to its cross-sectional representation in FIGS. 2 to 4 the cross-section is annular, with an outer, steel wall 3 which, as a result of the necessary high process temperatures, carries on its inside at least one brick-built, refractory lining layer 4.

The height of the kiln shaft 2 is determined by the residence times of the burning material to be process-determined in conjunction with the setting of the conveying rate by means of the discharge device 5. These residence times are distributed over an upper preheating zone 7 connected to the charging area 6, a downwardly following burning zone 8 and a cooling zone 9 extending to the discharge device 5.

The supply of gaseous, liquid or pulverulent fuel, preferably together with primary combustion air, takes place by means of numerous burning lances 13 arranged in one or more planes 10 to 12 and which extend through the shaft wall 3, 4 into the shaft chamber 2.

Figure 6:
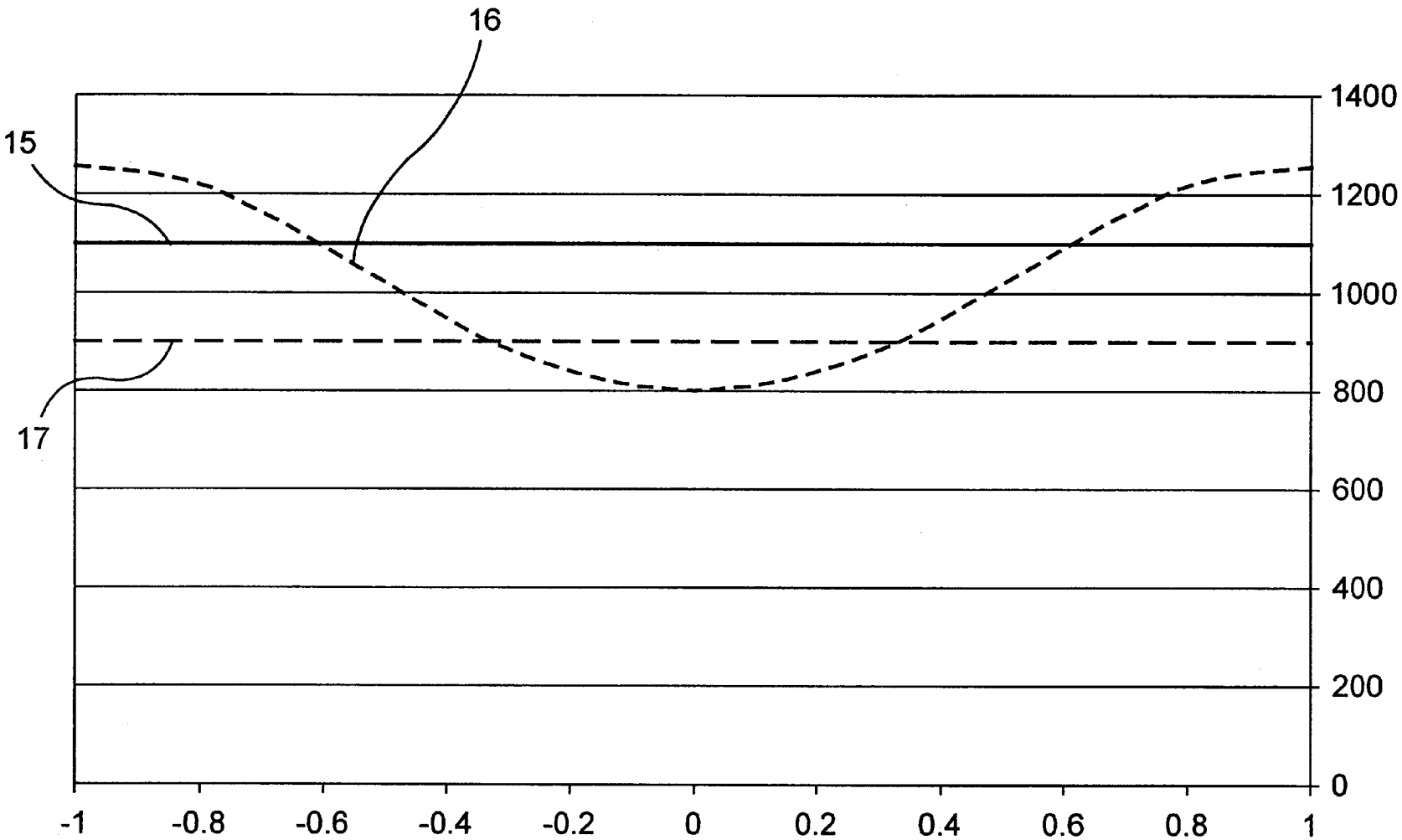
FIG. 6 A graph of the radial temperature distributions over a relative width shaft cross-section.

As a result of the manual axial displaceability of the burning lances in the bulk material, perpendicular through the brick-lined shaft wall 3, 4, it is possible to position the orifices 14 and therefore the flames formed thereat systematically or on the basis of temperature measurements using probes distributed over the shaft cross-section in such a way that there is a substantially uniform burning temperature in the shaft plane in question. Such a uniform temperature distribution is shown in the graph according to FIG. 6 by the straight path of the central curve 15. Compared with this in the case of an arrangement of the lance orifices 14 flush with the inside of the shaft wall 3,4 there would be a temperature pattern decreasing towards the shaft centre corresponding to curve 16 and therefore a differing degree of burning of the product. The temperatures in the vicinity of the shaft wall would be too high with the danger of sintering together and in the shaft centre too low and below the minimum burning temperature indicated by curve 17. The radial positions which can be read off the abscissa of the graph are only relative and not related to a specific shaft diameter. However, the shaft diameter can correspond to a radius of 1, although larger shaft dimensions can be implemented, e.g. with a diameter of 3 or 4 meters.

As a result of the high temperatures in the burning chamber 8 at least the burning lances 13 intended for an arrangement extending far into the shaft 2 are provided with a cooling jacket 19 surrounding the burning tube 18 and which is provided with connecting pieces 20, 21 for the passage of a cooling fluid. At burning lances 13 where a lower thermal stressing is expected, a heat-resistant material can be used for the particular lance area instead of a cooling jacket. This reduces the heat quantity dissipated via a cooling medium.

Figure 7:
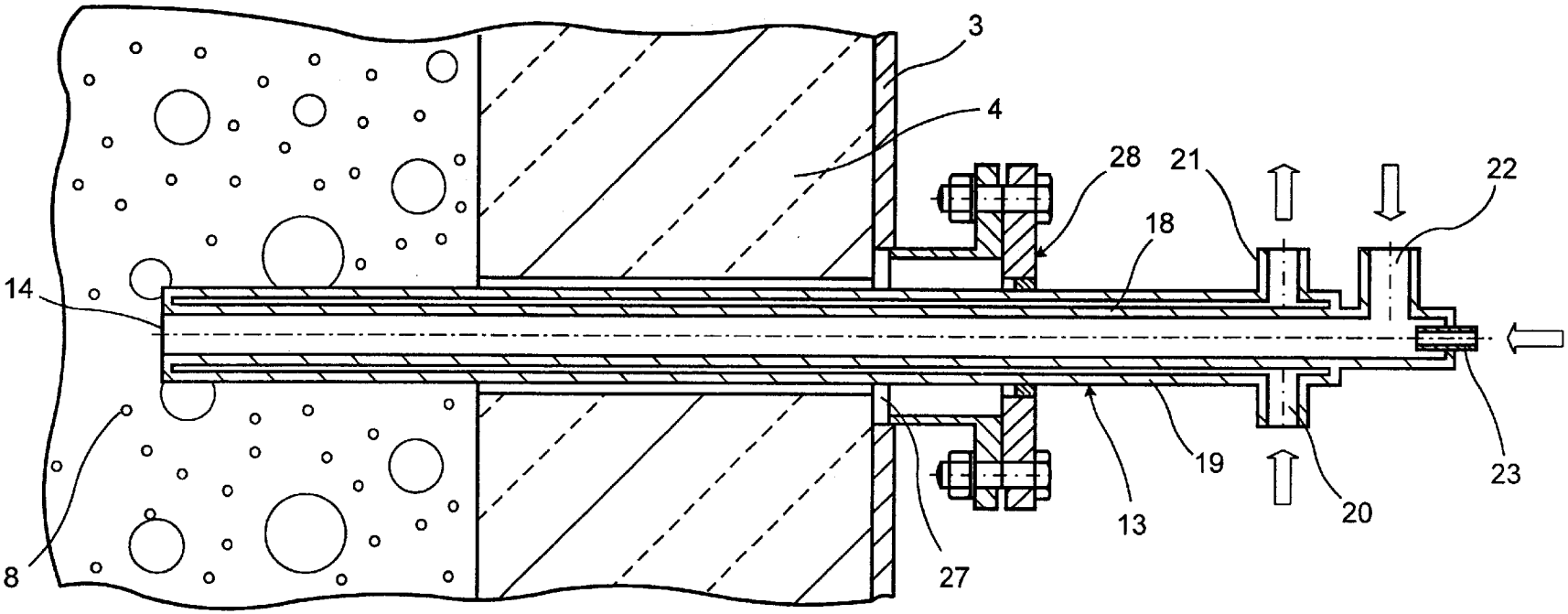
FIGS. 7 to 9 Cross-sectional representations of burning lances mounted on a shaft kiln for powdery, liquid and gaseous fuels.
Figure 8:
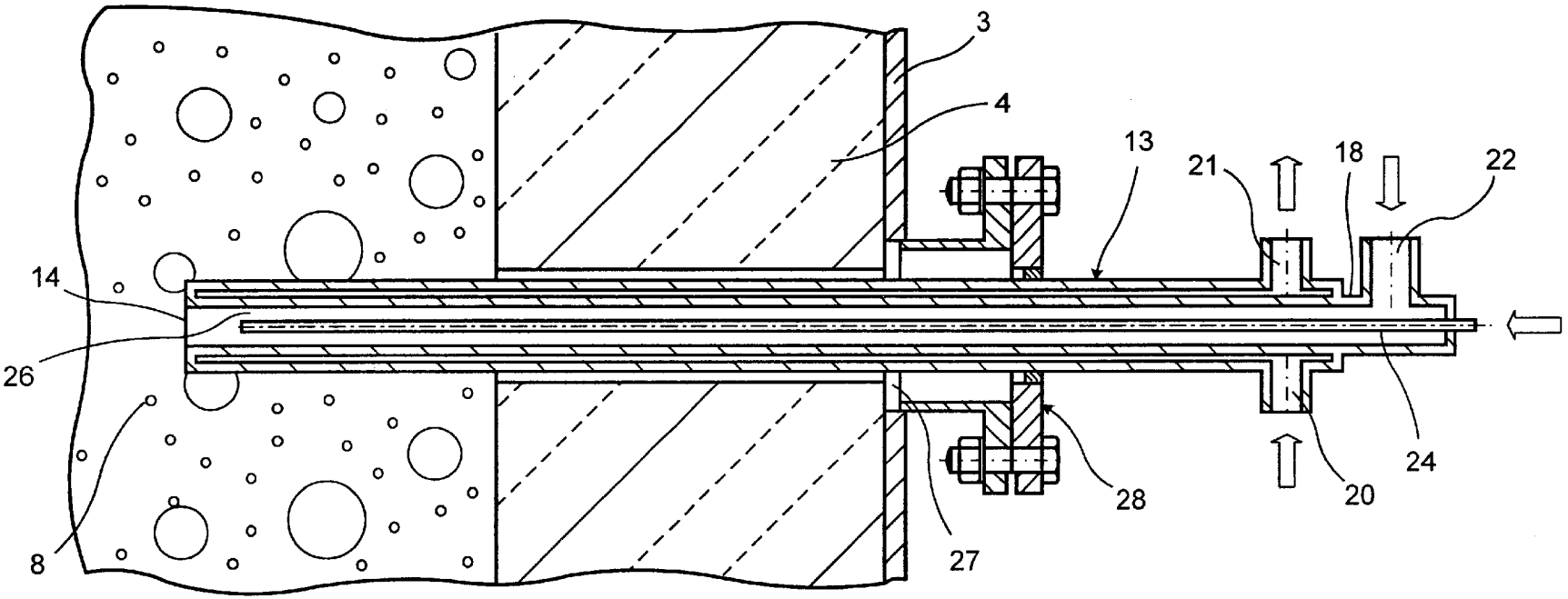
Figure 9:
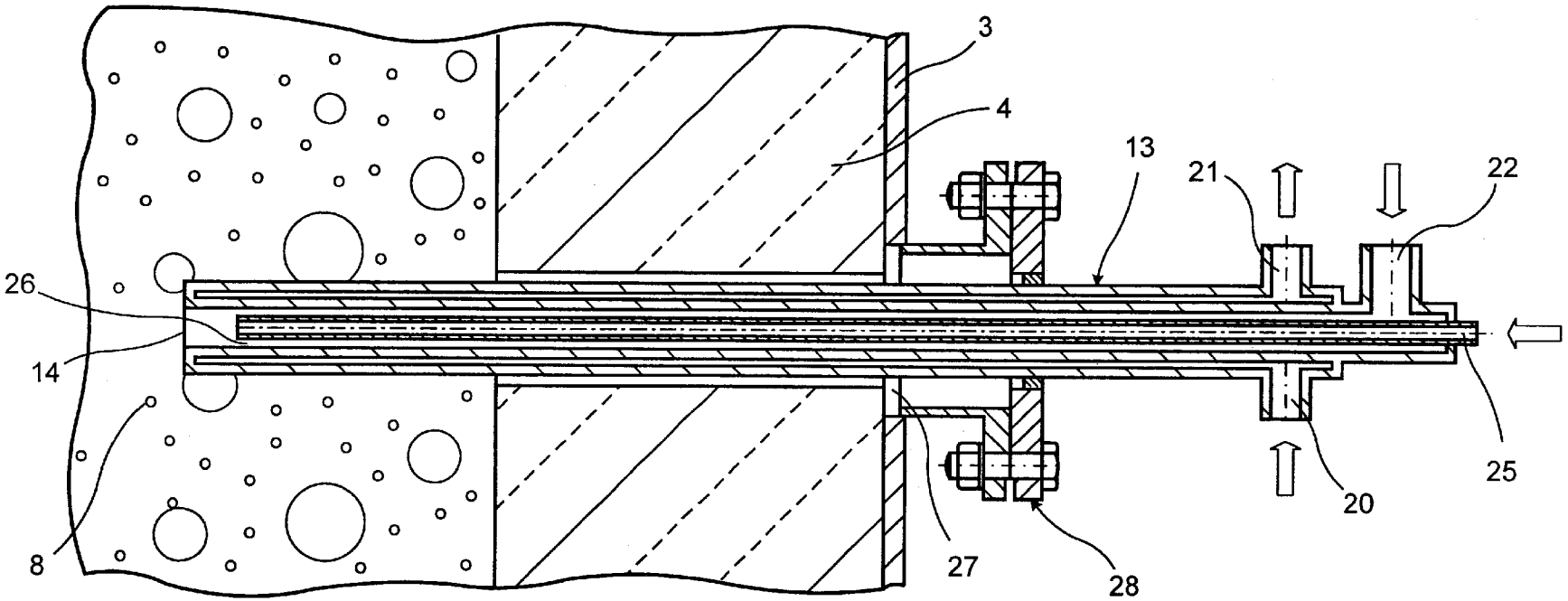

The burning tube 18 has a connecting piece 22 for the supply of primary combustion air. On the rear end of the burning lance 13 is introduced a fuel pipe 23, 24 or 25 running equiaxially therewith and which as a function of the nature of the fuel used can have a different construction. In the case of powdery fuel the fuel pipe is shaped like a short connecting piece 23 corresponding to FIG. 7. For liquid and gaseous fuel the fuel pipe 24 or 25 extends to just prior to the orifice 14 of the burning lance 13, in order to mix there with the primary combustion air flowing into the surrounding annular duct 26.

A passage of the burning lances 13 through the shaft wall 3, 4 of a displaceable nature, but which is tight with respect to the overpressure in the kiln, is in each case ensured by a stuffing box-type packing 28 connected outwardly to a wall bore 27.

Figure 3:
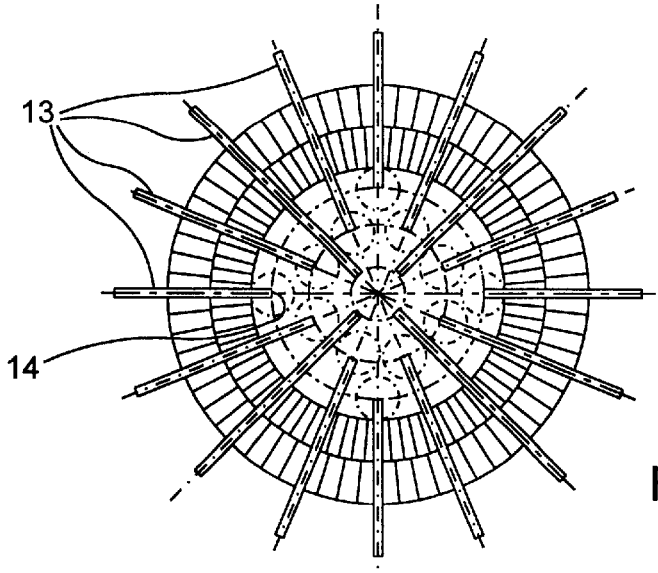
FIG. 3 A not to scale radial section through the kiln of FIGS. 1 or 2 in the vicinity of the upper plane of the burning lance arrangement.
Figure 4:
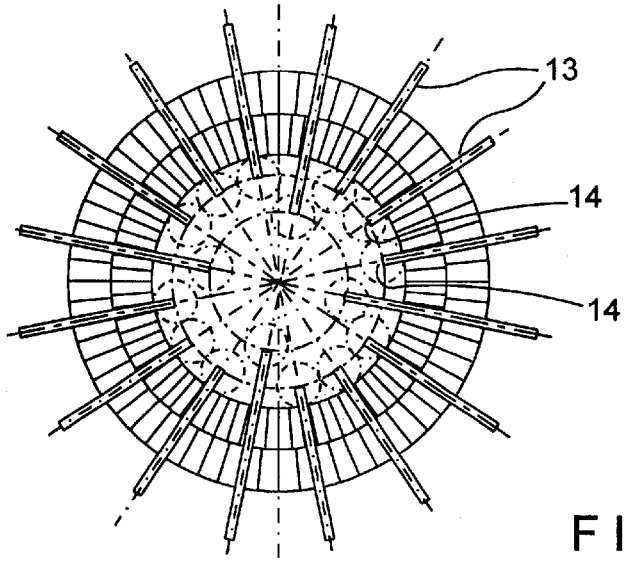
FIG. 4 A radial section through the kiln of FIG. 1 or 2 in the vicinity of the central plane of the burning lance arrangement.
Figure 5:
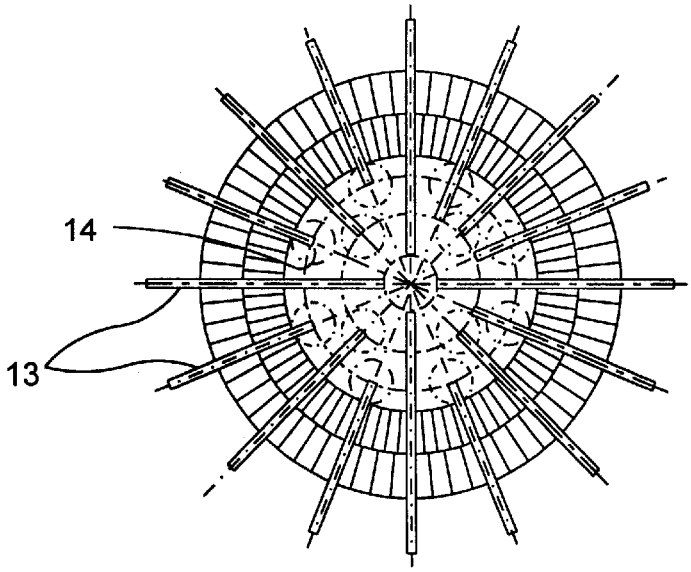
FIG. 5 A radial section through the kiln of FIG. 1 or 2 in the vicinity of the lower plane of the burning lance arrangement.

FIGS. 3 to 5 illustrate a different angular arrangement of the burning lances 13 arranged in three planes, so that the burning lances 13 are angularly displaced with respect to those of another plane. As a result of the different insertion positions of the burning lances 13 given in exemplified manner in the drawings in connection with the different burning planes 10, 11 and 12, even in the case of a small flame formation there is a particularly substantial coverage of the shaft cross-section by the flames forming at each of the orifices 14. The size of these flames is determined by several factors, i.e. the fuel quantity, the primary and secondary combustion air quantity and the grain size of the burning material. A small grain size leads to a denser bulk material packing and consequently to a reduced flame propagation. However, the limitation of the grain size to a range of preferably less than 70 mm has the advantage of reduced mechanical stressing of the burning lances 13 projecting transversely into the flowing bulk material and the advantage of a small, adjustable residence time, so that a sintering together of burning material can be prevented by a short residence time. For a uniform degree of burning the grain size distribution should be within the smallest possible range.

If the method is to be carried out with a grain size of the burning material which is well above a maximum grain size of 70 mm, then special measures can be taken which prevent an overloading or overstressing of the burning lances 13 extending far into the shaft 2. For example, the particular burning lance can be held in the manner of a movable beam, with a force measuring point outside the shaft wall 3 and with a device for producing mechanical vibrations, which is automatically connected in on exceeding a permitted force. In this way the burning lance can be jolted free if there should be an accumulation of material thereon. A jolting of the burning lance can also facilitate its insertion into the filled shaft chamber 2.

The fuel supply in the individual burning planes 10, 11 and 12 can be individually set down to zero so that, as a function of the desired degree of burning and the residence time in a particular temperature range, a specific temperature pattern can be obtained in the shaft longitudinal direction or the flow direction of the air flowing in from below.

This air is supplied with overpressure by at least one not shown blower in the vicinity of the discharge device 5 e.g. constructed as sliding table, so that it flows upwards in counter-current to the bulk material column moving downwards by gravity as a result of the granular structure thereof. In the cooling zone 9 it firstly serves as cooling air and then in burning zone 8 as e.g. secondary combustion air, then finally in the upper preheating zone 7 of the kiln for preheating the material being burned. In accordance with a preferred embodiment of the invention it is used for preheating the primary combustion air flowing to the burning lances 13 in heat exchange tubes 36 arranged in suspended manner there.

The inventively essential arrangement of the burning lances 13 or their orifices 14, distributed over the shaft cross-section, makes it possible to bring about novel manners of controlling the procedure, with particularly high flame temperatures in the range of 1800øC with a short residence time, without the sintering together otherwise expected at such temperatures occurring, i.e. the formation of blocks, so that it is possible to bring about a hitherto unachievable hard burning in the vertical shaft kiln with gaseous, liquid and powdery fuels.

The graphs of FIGS. 10 to 13 show for a specific residence time the temperature patterns for the burning material lime ($CaCO_3$), based on the longitudinal section of the shaft furnace obtainable as a result of the control of the fuel supply in conjunction with adapted primary air supply over the burning lances 13 and secondary combustion air supplied in counter-current form. The temperature of the burning material is shown by a continuous line 30, whereas the temperature of the burning gas forming as a result of the combustion and the cooling or secondary combustion air is illustrated by the broken line 31.

Figure 11:
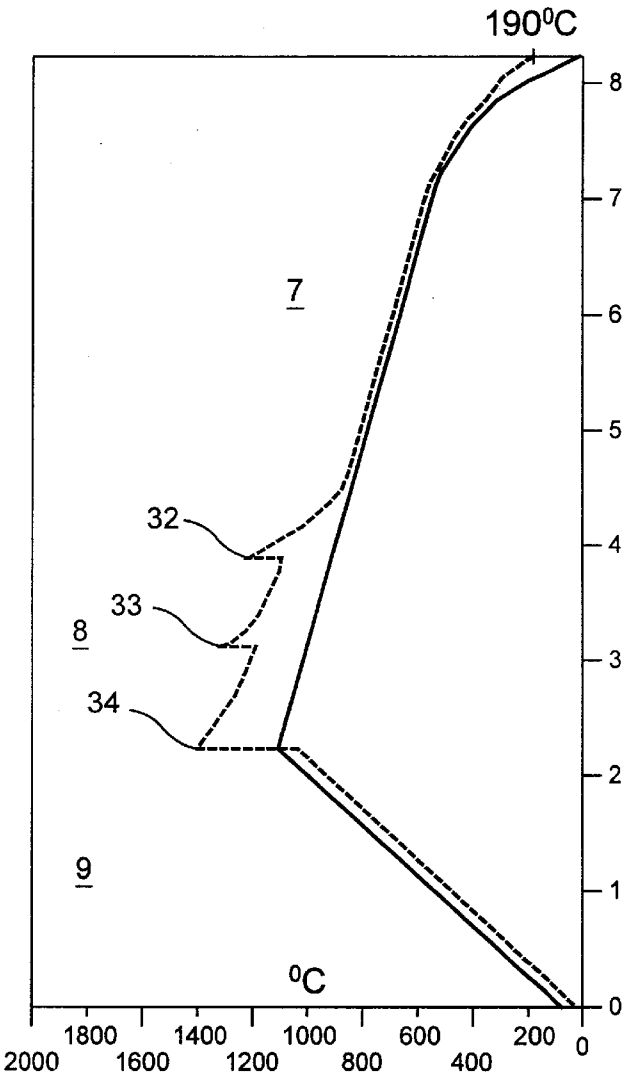
FIG. 11 A graph corresponding to FIG. 10, but in a kiln according to FIG. 2.
Figure 10:
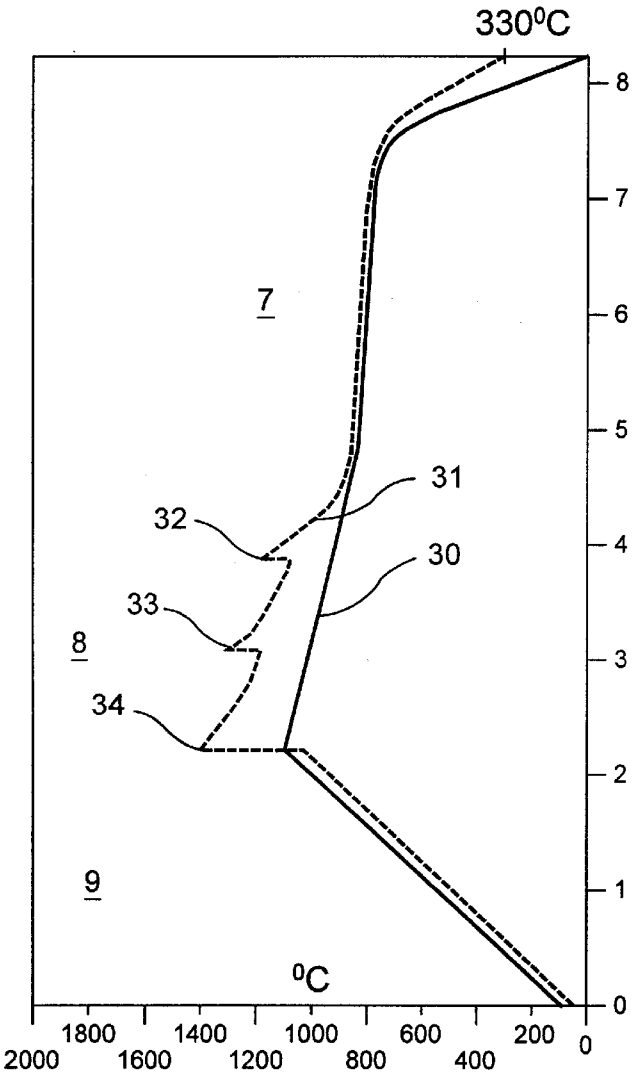
FIG. 10 A graph of the vertical temperature distribution in the shaft kiln according to FIG. 1 with fuel supply for soft burning in three burning planes.

For the production of soft burned products in accordance with FIGS. 10 and 11 the fuel supply takes place intermittently over the burning lances 13 arranged in three burning planes 10 to 12 using a significantly smaller quantity than for hard burned products, so that flame temperatures corresponding to the three temperature peaks 32 to 34 form, which are approximately 1200° C. in the first burning plane and approximately 1400° C. in the third burning plane. The burning material flowing from top to bottom consequently passes in the first burning zone 30 firstly into contact with the burning gas at 1200° C. and in the following burning planes with hotter burning gas at max approximately 1400° C. Through the burning gas flowing upwards in counter-current manner the granular burning material would already be preheated to approximately 1000° C. on reaching the first burning plane and in the third burning plane reaches a temperature of approximately 1200° C. As a result of the supply of the necessary fuel quantity distributed over three burning planes 10, 11, 12, the burning zone 8 has a correspondingly long extension in the shaft direction with a correspondingly long residence time of the burning material in the burning zone 8.

Figure 12:
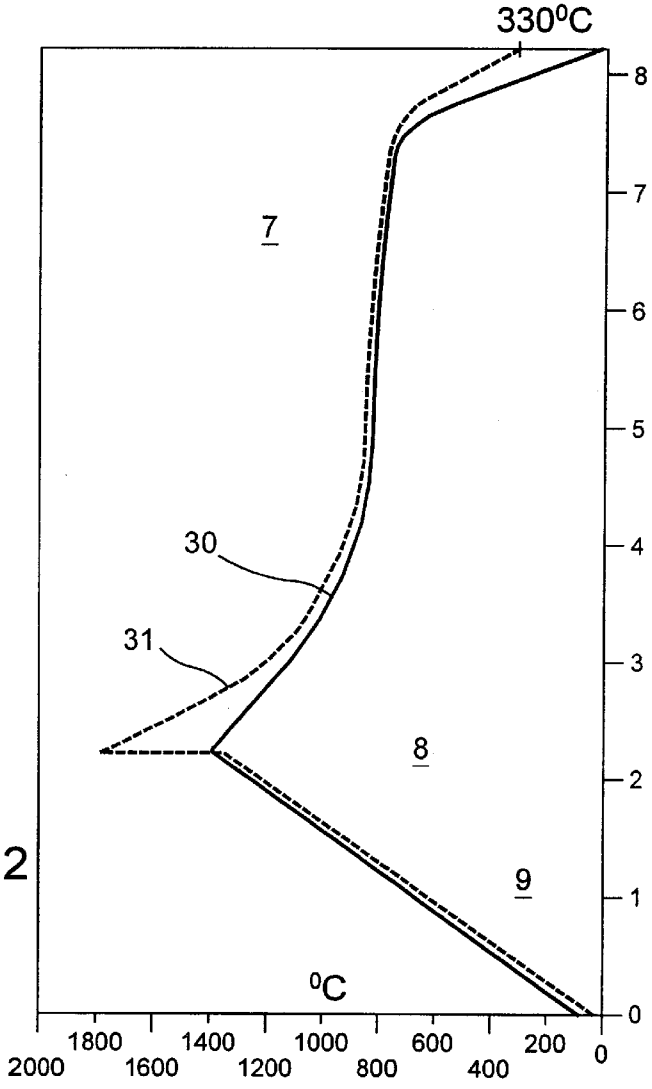
FIG. 12 A graph of the vertical temperature distribution in the shaft kiln according to FIG. 1 with fuel supply for hard burning in a single burning plane.

The hard burning of lime hitherto impossible in shaft kilns, with the exception of mixing firing kilns, takes place in accordance with the embodiment of FIG. 12 with the fuel supply and primary combustion air supply in a single plane 12 and at a flame temperature of approximately 1800° C. The burning material has a grain size of 5 to 70 mm. The resulting high burning temperature of approximately 1400° C. surprisingly does not lead to a sintering together of burning material grains with the formation of lumps and bridges. This is due to a short residence time at maximum temperatures, corresponding to the pointed configuration of the temperature curve 31 for the burning material in the graph of FIG. 12. This temperature pattern results from the fact that additional burning planes are not used and also through the correspondingly shorter extension of the burning zone 8 in the shaft direction.

In the construction of the single shaft kiln 1 corresponding to FIG. 1 the burning gases cooling in the preheating zone 7 leave the kiln at approximately 330° C., so that correspondingly high thermal losses occur. Due to the large amount of dust in the waste gas flow, a recovery in following heat exchangers would rapidly lead to the formation of deposits hindering heat transfer. In a preferred development of the invention corresponding to FIG. 2 part of the thermal energy in the burning gases is utilized for heating primary combustion air supplied to the burning lances 13 by a line 39. This heating takes place within the kiln 1', in that the combustion air is passed through heat exchange tubes 36, which are immersed in the burning material of the preheating zone 7 with a delivery and return part 37, 38, in vertically suspended manner and distributed circumferentially of the shaft 2 or uniformly over the shaft cross-section. The arrangement of the heat exchange tubes 36 in the kiln 1' in direct contact with the material being burned and the burning gases leads to a particularly good heat transfer by heat conduction, convection and heat radiation. In addition, the heat exchange surfaces of the tubes 36 are automatically cleaned by the burning material flowing along them under the influence of gravity. The resulting possible thermal energy economies, compared with a kiln without any primary combustion air preheating, represent approximately 7 to 10%, for a waste gas temperature of approximately 190° C. instead of approximately 330° C.

Figure 13:
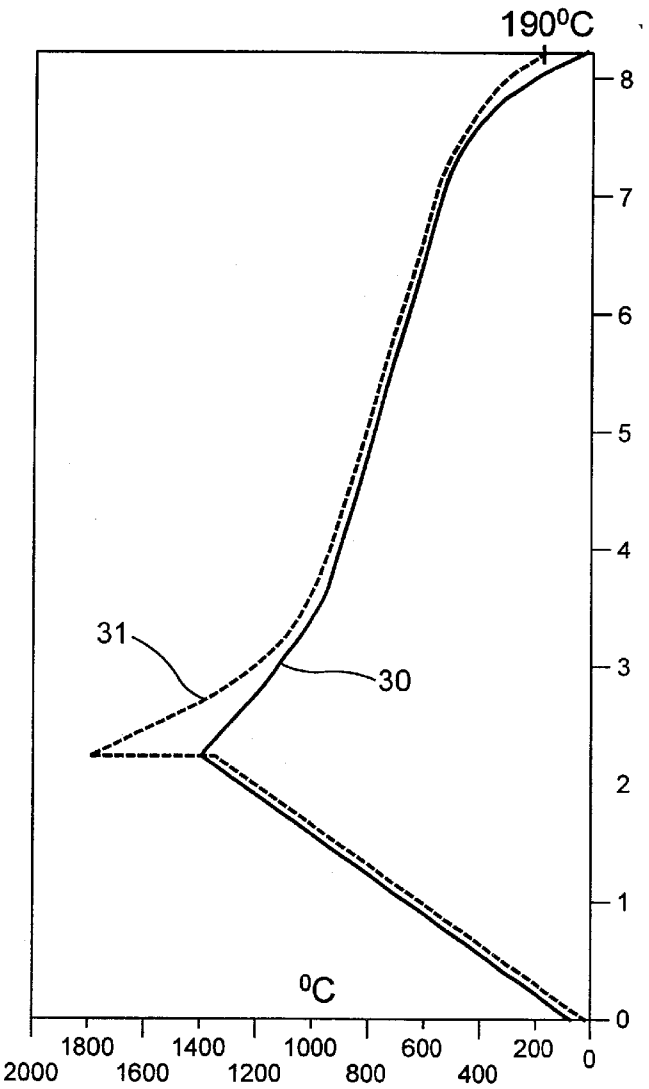
FIG. 13 A graph corresponding to FIG. 12, but in a kiln according to FIG. 2.

FIGS. 11 and 13 illustrate the different temperature pattern in the shaft direction resulting from the additional heat exchange in the tubes 36.

Figure 14:
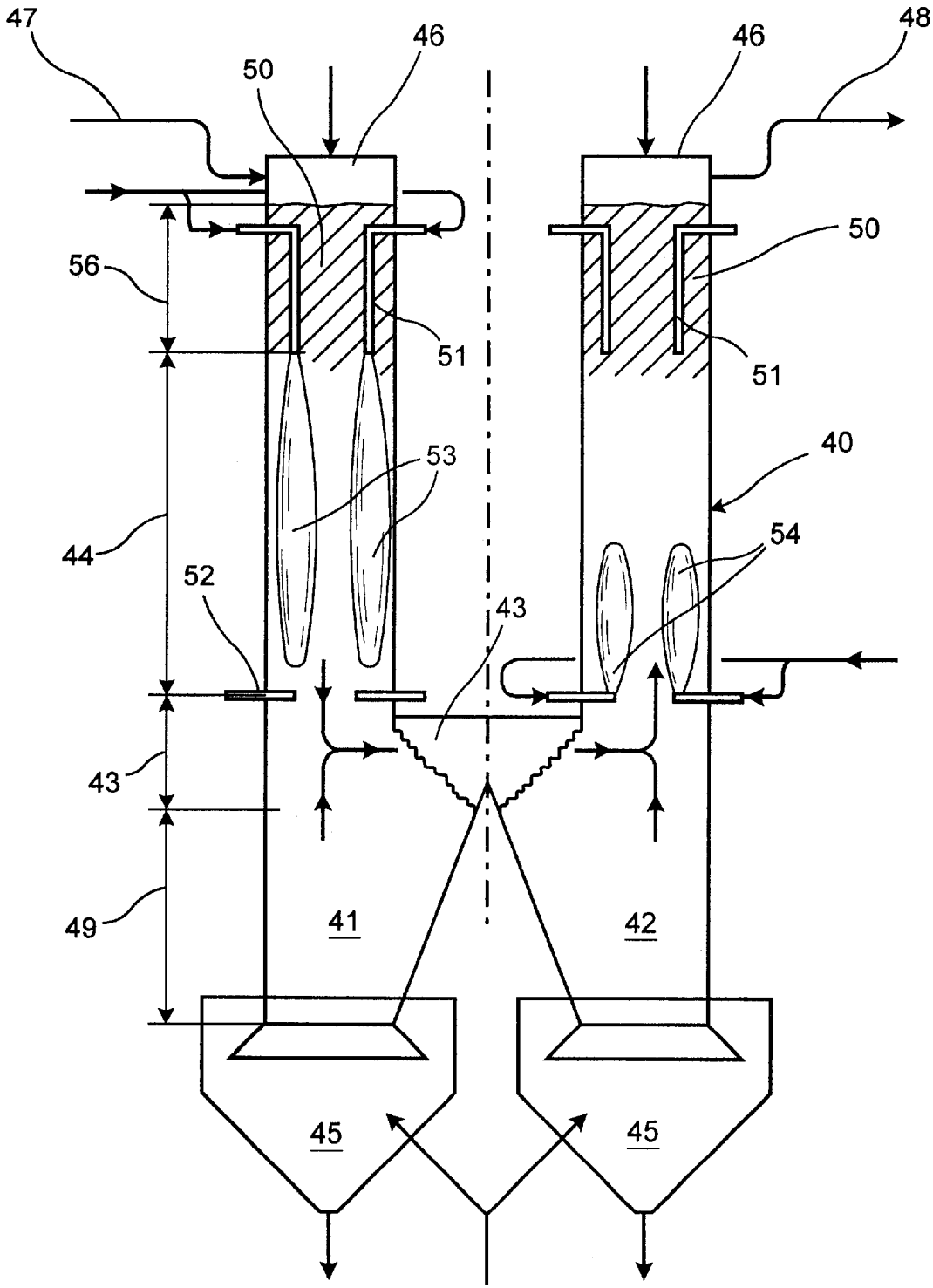
FIG. 14 A multi-shaft kiln according to the regenerative method, with suspended, transversely positioned burning lances.
Figure 15:
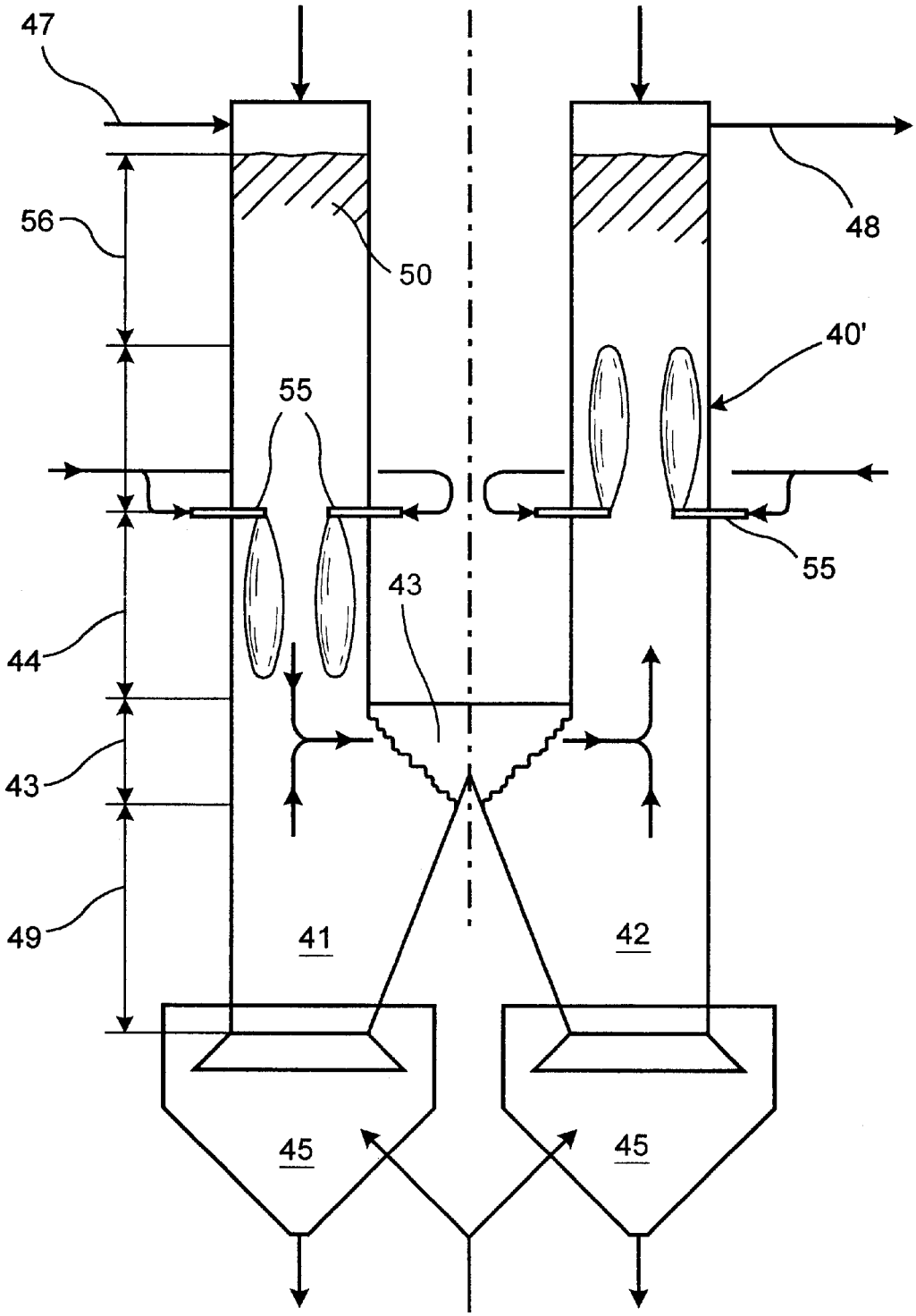
FIG. 15 A multi-shaft kiln according to the regenerative method with only transversely positioned burning lances.
Figure 16:
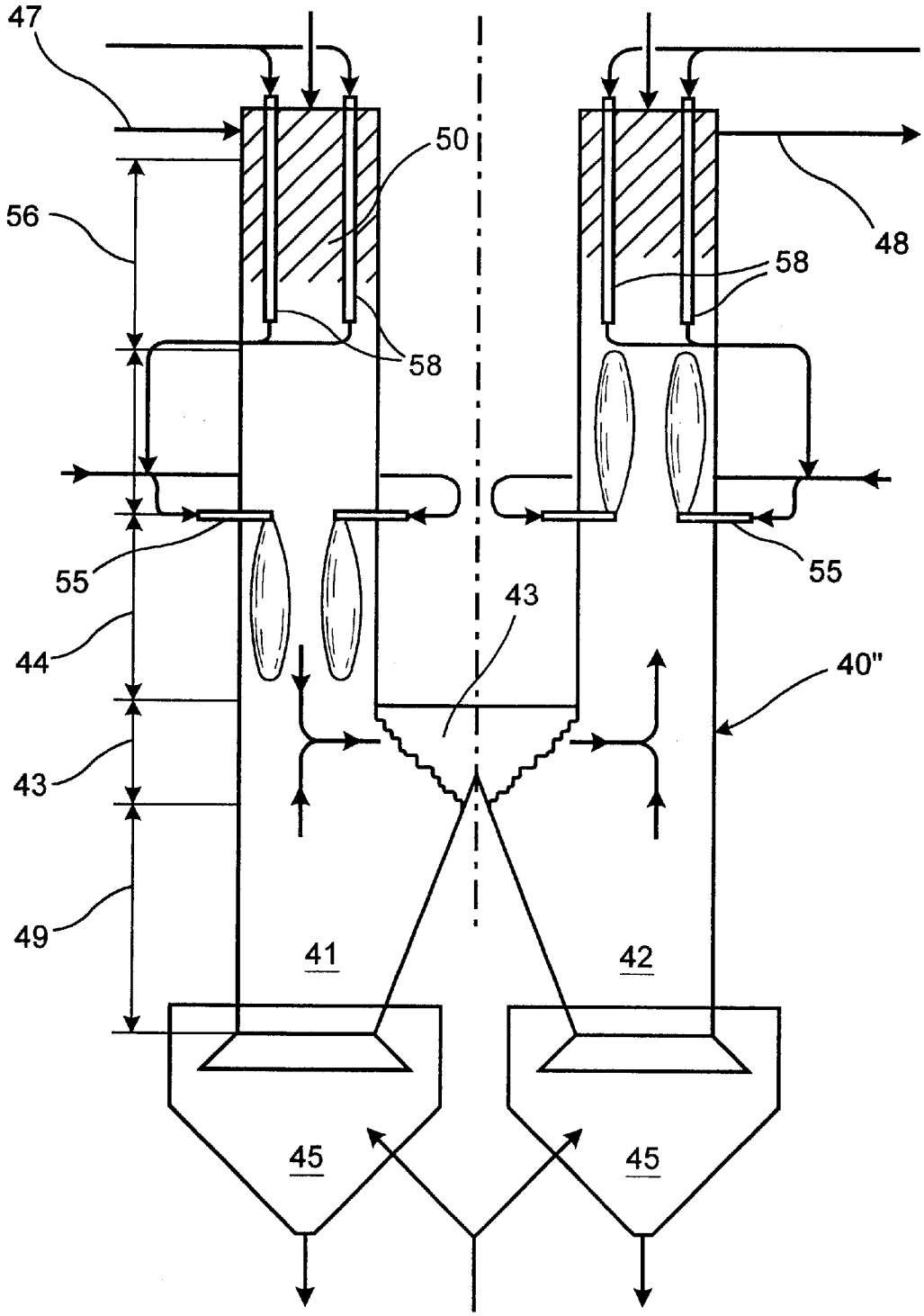
FIG. 16 A multi-shaft kiln according to the regenerative method, with only transversely positioned burning lances and with heat exchange tubes located in the upper shaft areas.

The double shaft kilns 40, 40' and 40" of the embodiments according to FIGS. 14 to 16 are operated in accordance with the regenerative method in the same way as the known MAERZ kiln. This means that both shafts 41 and 42 are cross-connected with one another in the transition area 43 below the burning zone, that from the discharge area 45 cooling air is continuously supplied in counter-current manner and that from the charging area 46 combustion air is supplied in parallel flow alternatively to one or other of the shafts 41, 42, whilst simultaneously the waste gases are led off from the kilns 40, 40', 40" through the preheating zone of the adjacent shaft 42 or 41. The switching of these flow conditions in the kiln takes place at time intervals of e.g. 10 to 15 minutes. FIGS. 14 to 16 illustrate by directional arrows the operating state in which combustion air is supplied by line 47 to shaft 41 and gas is led off from the other shaft 42 by line 48. Using the same switching principle it is also possible to operate more than two parallel shafts 41, 42 with alternating operating states.

Unlike in the parallel flow-regenerative kiln known as the MAERZ kiln, in which fuel, corresponding to the operating intervals, is alternately supplied to only one or other the shafts in parallel flow with the material being burned, the fuel supply takes place simultaneously to both shafts 41, 42, so that in one of the shafts the burning gases are directed in parallel to the burning material and are in counter-current therewith in the other shaft. Therefore all the necessary fuel supply is distributed over the burning lance arrangements of both shafts 41, 42. Unlike in the case of parallel flow burning operation in a single shaft 41 or 42, in the other shaft 42 or 41 burning takes place with combustion air preheated in the cooling zone 49 and as a result there is a reduced waste gas quantity and a correspondingly improved energy balance. As compared with parallel flow, regenerative MAERZ-type kilns, when burning limestone the waste gas reduction can amount to 25%. This leads to a rise in the carbon dioxide concentration, so that the waste gas can advantageously be used for chemical processes requiring a gas with a high carbon dioxide content.

In the case of the double shaft kiln according to FIG. 14 in addition to the burning lances 51 immersed from above in the burning material 50 in the vicinity of the transition area 43 burning lances 52 are transversely inserted into the burning material 50. After switching over burning operation, consequently in the same shaft in place of the suspended burning lances 51 the transversely inserted burning lances 52 are put into operation, whilst a simultaneously reversed switching of the burners 52, 51 in the other shaft takes place. The direction of flame formation at the nozzle orifices of the burning lances 51, 52 in the shaft direction is made apparent by the representations of the flames 53 and 54. They also make it clear that the transversely directed burning lances 52 of shaft 41 are switched off during the operation of the burning lances 51 suspended in said shaft 41, whereas in the other shaft 42 the burning lances 52 are connected in.

Only transversely positioned burning lances 55 are provided in both shafts 41, 42 of the double shaft kiln of FIG. 15. The double shaft kiln of FIG. 16 has also heat exchange tubes 58 arranged in suspended manner in the preheating area 56 for the heating of primary combustion air, in the manner described hereinbefore in conjunction with the single shaft kiln of FIG. 2.

Through the simultaneous supply of fuel in the second shaft in counter-current manner through burning lances 52, 55 introduced into the burning material, the per se known regenerative method, in the case of good thermal efficiency, is advantageously also made suitable for the production of medium and hard burned products.

What is claimed is:

1. In a method for burning carbonate-containing material in a shaft kiln, wherein the carbonate containing material is supplied to the shaft kiln with gravity conveying the carbonate-containing material through a preheating zone, at least one burning zone and a cooling zone to a discharge device, wherein a fuel supply in the burning zone or adjacent thereto takes place by means of a plurality of burners and combustion air is supplied under overpressure as cooling air, the improvement wherein the fuel supply takes place by means of a plurality of burning lances displaceable into the shaft chamber perpendicular to the shaft wall and positioned with respective orifices of the lances disposed within the chamber and spaced from the shaft wall such that individual flames formed on the burning lances together form a flame area, which at least approximately extends over the entire shaft cross-section.

2. Method according to claim 1, wherein the fuel supply takes place by means of a plurality of superimposed groups of burning lances with each group arranged at least approximately in the same plane, and as a function of the desired degree of burning in the burning zone a temperature profile passing in the kiln longitudinal direction is regulated by modifying the fuel supply to one or more of the lance groups.

3. Method according to claim 2, wherein for a uniform, common coverage of the shaft cross-section by individual, superimposed flame areas, the displacement direction of superimposed burning lances is mutually staggered in the circumferential direction of the shaft.

4. Method according to claim 3, wherein for burning purposes a choice is made of a burning material with a grain size in the range 5 to 70 mm.

5. Method according to claim 2, wherein for burning purposes a choice is made of a burning material with a grain size in the range 5 to 70 mm.

6. Method according to claim 1, wherein the burning lances supply in addition to fuel combustion air, whose quantity is adjustable and if necessary can be reduced to zero.

7. Method according to claim 6, wherein the combustion air to be supplied by means of the burning lances is heated within the preheating zone by being passed through heat exchange tubes, which are positioned parallel to the shaft wall, distributed over the kiln cross-section and suspended in the preheating area of the kiln.

8. Method according to claim 7, wherein for burning purposes a choice is made of a burning material with a grain size in the range 5 to 70 mm.

9. Method according to claim 6, wherein for burning purposes a choice is made of a burning material with a grain size in the range 5 to 70 mm.

10. Method according to claim 1, wherein the maximum insertion depth of the burning lance extends close to the centre of the shaft cross-section, so that the associated flame reaches the centre and the internal diameter of the shaft chamber is reduced to 3 m.

11. Method according to claim 1, wherein for burning purposes a choice is made of a burning material with a grain size in the range 5 to 70 mm.

12. Method according to claim 1, wherein a cooling medium flows at least through the burning lances projecting furthest into the shaft chamber.

13. In a regenerative method for burning carbonate-containing material in a multi-shaft kiln comprising a plurality of shafts transversely connected to one another, wherein the carbonate containing material is conveyed through respective chambers of the shafts and fuel is supplied alternately to a burning zone of one of the respective chambers and then to another of the respective chambers by means of respective burners, and wherein a time-alternating supply of combustion air in parallel flow is provided between the respective shafts of the kiln and a continuous counter flow supply of cooling air is provided in a lower area of the shafts, the improvement wherein, during fuel supply to a first of said chambers, fuel is supplied to a second of said chambers by means of a plurality of burning lances disposed in the burning zone of said second chamber, said plurality of burning lances being displaceable into the second chamber perpendicular to a shaft wall of said second chamber, respective orifices of said burning lances being positioned such that individual flames formed on the burning lances together form a flame area which at least approximately extends over an entire cross-section of the second shaft.

14. The method according to claim 13, wherein fuel is supplied in one of the shafts during an operating period of the regenerative method in parallel flow form by means of a plurality of suspended lances.

15. The method according to claim 13, wherein the burning lances that are displaceable perpendicular to the shaft wall supply, in addition to fuel, combustion air whose quantity is adjustable and can be reduced to zero.

16. The method according to claim 15, wherein the combustion air supplied by means of the burning lances is heated within a preheating zone by being passed through heat exchange tubes which are positioned parallel to the shaft wall, said heat exchange tubes being distributed over a cross-section of the kiln and suspended in the preheating zone.

17. The method according to claim 13, wherein the carbonate-containing material conveyed through the respective chambers for burning has a grain size in the range of 5 to 70 mm.

18. The method according to claim 13, wherein a cooling medium flows at least through a burning lance projecting furthest into the second chamber.

19. In a method for burning carbonate-containing material in a shaft kiln, wherein the carbonate containing material is supplied to the shaft kiln with gravity conveying the carbonate-containing material through a preheating zone, at least one burning zone and a cooling zone to a discharge device, wherein a fuel supply in the burning zone or adjacent thereto takes place by means of a plurality of burners and combustion air is supplied under overpressure as cooling air, the improvement wherein the fuel supply takes place by means of a plurality of burning lances displaceable into the shaft chamber perpendicular to the shaft wall and positioned with respective orifices of the lances disposed within the chamber and spaced from the shaft wall such that individual flames formed on the burning lances together form a flame area, which at least approximately extends over the entire shaft cross-section, wherein the temperature distribution over the shaft cross-section is adjusted by displacement of the burning lances whereby to effect adjustment of radial positions of the burner orifices during kiln operation, said adjustment being done as a function of temperature values determined by a probe or by a product quality determination.

20. The method according to claim 19, wherein the carbonate-containing material being burned has a grain size in the range of 5 to 70 mm.

* * * * *